US006561289B2

(12) United States Patent
Portman et al.

(10) Patent No.: US 6,561,289 B2
(45) Date of Patent: May 13, 2003

(54) BOTTOMHOLE ASSEMBLY AND METHODS OF USE

(75) Inventors: Lance N. Portman, The Woodlands, TX (US); John E. Ravensbergen, Calgary (CA)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 09/850,440

(22) Filed: May 7, 2001

(65) Prior Publication Data

US 2001/0022241 A1 Sep. 20, 2001

Related U.S. Application Data

(62) Division of application No. 09/355,216, filed as application No. PCT/US98/03244 on Feb. 20, 1998, now abandoned.
(60) Provisional application No. 60/038,454, filed on Feb. 20, 1997.

(51) Int. Cl.[7] ..... E21B 4/04; E21B 7/04
(52) U.S. Cl. ..... 175/104; 175/73; 166/66.4
(58) Field of Search ..... 166/66.4, 66.6; 175/73, 104, 100

(56) References Cited

U.S. PATENT DOCUMENTS

| | | | | | |
|---|---|---|---|---|---|
| 4,143,722 | A | * | 3/1979 | Driver | 175/104 |
| 4,476,923 | A | * | 10/1984 | Walling | 166/105 |
| 4,715,453 | A | * | 12/1987 | Falgout et al. | 175/325.3 |
| 5,060,737 | A | * | 10/1991 | Mohn | 174/47 |
| 5,320,182 | A | * | 6/1994 | Mendez | 166/106 |
| 5,984,011 | A | * | 11/1999 | Misselbrook et al. | 166/312 |
| 6,047,784 | A | * | 4/2000 | Dorel | 175/61 |
| 6,126,401 | A | * | 10/2000 | Latham | 417/16 |

FOREIGN PATENT DOCUMENTS

| | | | |
|---|---|---|---|
| GB | 2240376 | * | 7/1991 |

* cited by examiner

*Primary Examiner*—Thomas B. Will
*Assistant Examiner*—Nathan Mammen
(74) *Attorney, Agent, or Firm*—Sue Z. Shaper, P.C.

(57) ABSTRACT

A bottomhole assembly (BHA) for use in well operations, with particular application to use in drilling with a downhole drilling motor and with coiled tubing and directional drilling, including a novel power pack, orienting tool, arrangement of bottomhole assembly tools, and method of use of the BHA for orienting while drilling.

26 Claims, 8 Drawing Sheets

FIG. 1
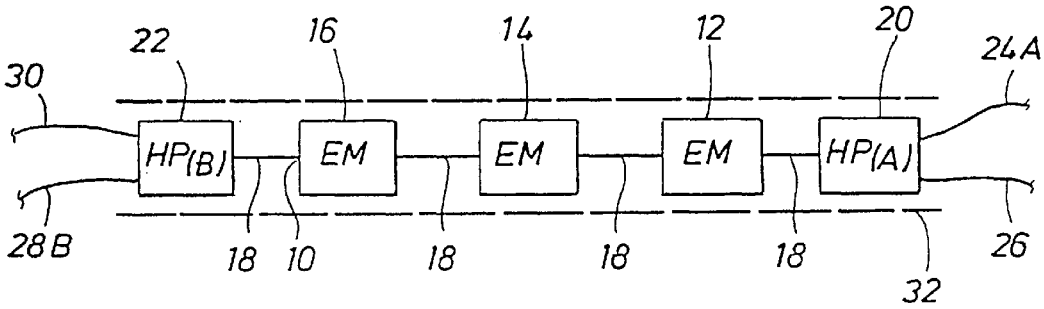
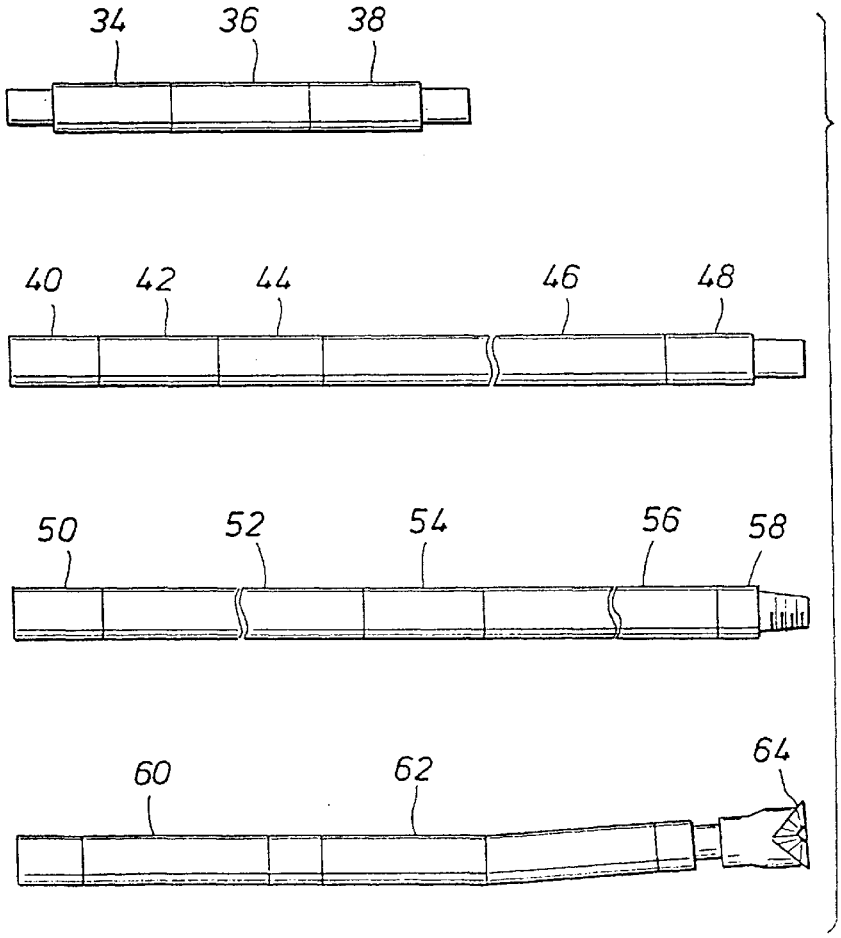
FIG.2A

FIG. 7
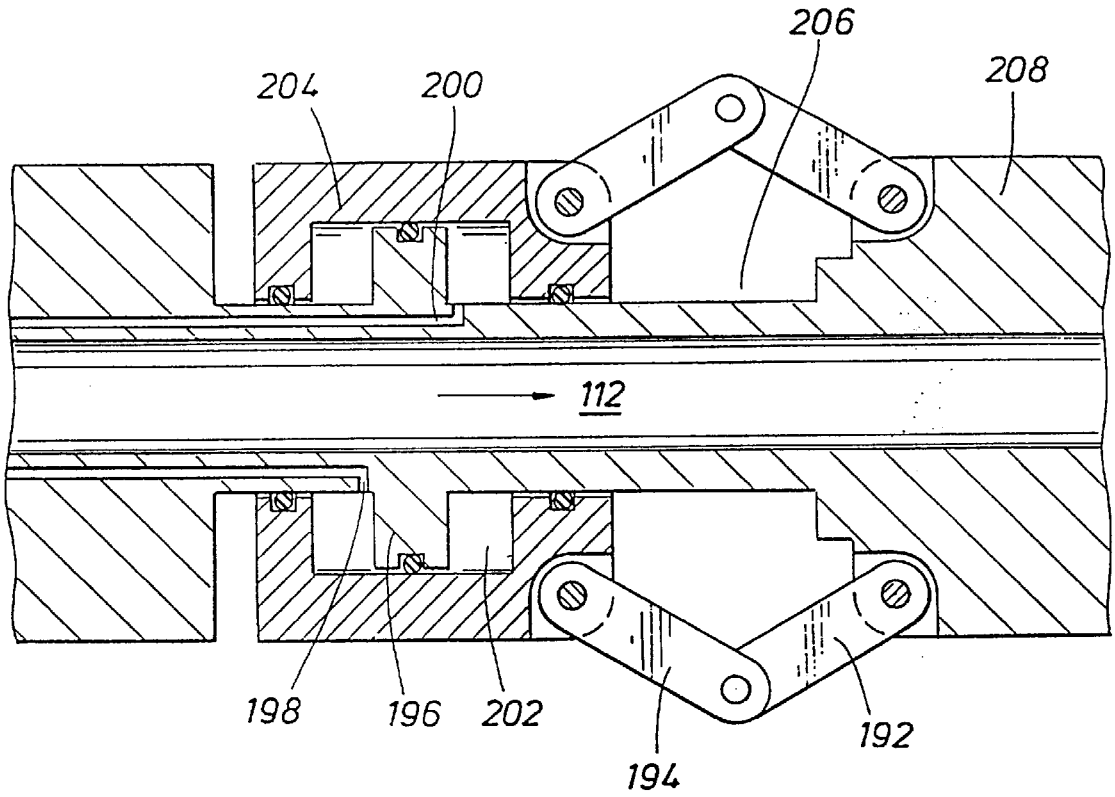
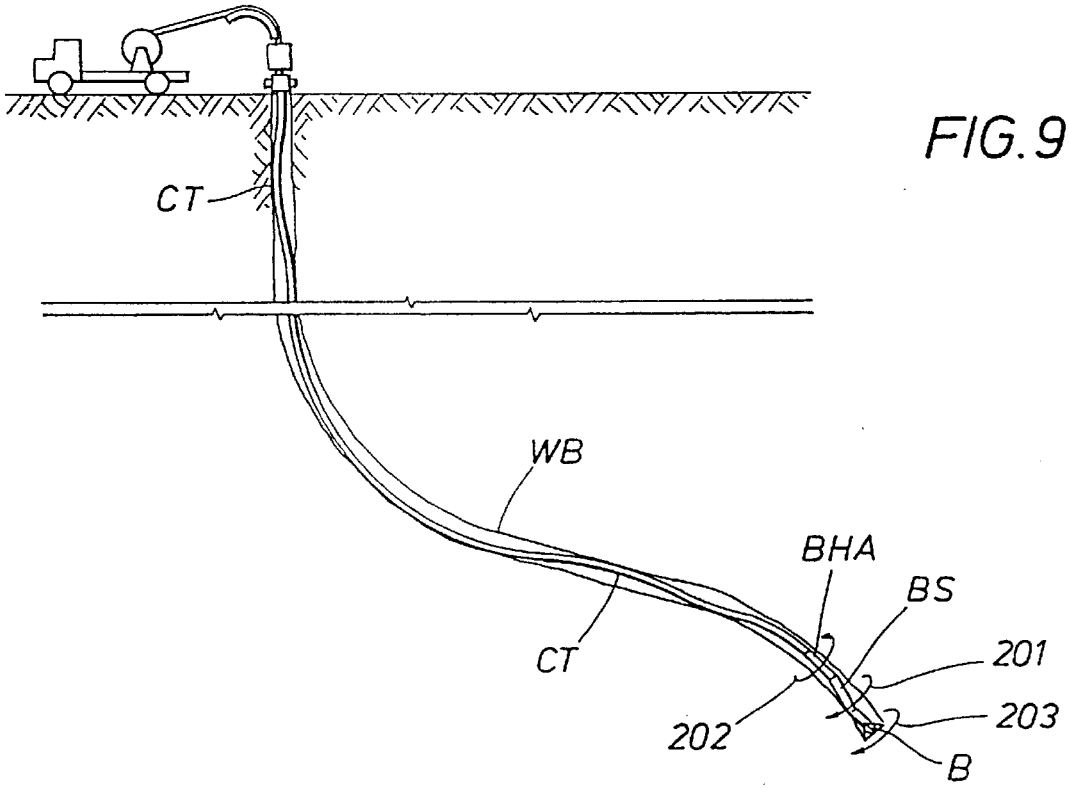
FIG. 9

BOTTOMHOLE ASSEMBLY AND METHODS OF USE

This application relates to and is a divisional application of co-pending application Ser. No. 09/355,216 filed Jul. 23, 1999, now abandoned. Ser. No. 09/355,216 is a national stage of PCT US 98/03244, filed Feb. 20, 1998 and claiming priority based on U.S. Ser. No. 60/038,454 filed Feb. 20, 1997. Thereby this application also claims priority based on U.S. Ser. No. 60/038,454.

FIELD OF THE INVENTION

This invention relates to a bottomhole assembly (BHA) for use in well operations, with particular application to use in drilling with a downhole drilling motor and coiled tubing, and the invention relates to related methods of use of a BHA

BACKGROUND OF THE INVENTION

The B J Nowsco directional drilling-using-coiled-tubing (D U C T) is an on-bottom orientation and steering system for the tool string. The orient-while-drilling system provides joystick drilling. The heart of the system, that which enables orient-while-drilling, or on-bottom orientation/steering, or joystick drilling, is a downhole electric-over-hydraulic power pack. This B J Nowsco power pack when combined with a rotating tool can generate torque greater than the reactive torque of the drilling motor. This torque should be greater than at least 700 foot pounds and preferably greater than 1,000 foot pounds. The downhole electric-over-hydraulic power pack can also be advantageously used to power other downhole tools, other than a rotating tool or an orienting tool, such as a circulating valve, or other valves. Also for example, the power pack could power an emergency release tool. The power pack could power a form of orienting tool that varied the offset of an offset joint, such as bent sub angle. (Rams or cams, as well as bents subs, can form species of offset joints, as that term is used herein.)

The power pack is preferably powered by an electric line that runs through coiled tubing. Running an electric line through coil instead of hydraulic lines has several advantages, one being space. Reversible DC motors are preferably selected for the electric motors. Given space constraints, preferably three DC motors would be run in sequence. In a preferred embodiment a hydraulic pump is placed both above and below three DC motors. A clutch is provided for each pump, so that when the motors are run in one direction one of the two hydraulic pumps generates hydraulic pressure in its line while the clutch slips the other pump. When the electric motors are run in the opposite direction, the other clutch slips and the first clutch engages so that the other hydraulic motor generates pressure in its line. The availability of two hydraulic lines facilitates powering double acting pistons. Check valves can be used to lock double acting pistons in place. High pressure relief valves can be used to differentially run second and third systems off the same hydraulic line as the first system. For instance, a first level of pressure could be used to move a piston relating to a rotating orienting member. If the piston were moved to one of its end positions and pressure subsequently built up, a relief valve could open that would allow the hydraulic fluid to then operate a circulation valve, for instance, or a second double acting piston system. A third relief valve could be placed on the same hydraulic line such that after the second piston had been moved to its stop position, pressure further builds up to open a third valve and to permit the hydraulic line to adjust the degree offset of an offset tool, for example, by running a third piston system.

A further aspect of the invention derives from the high level of torque generated by the downhole electric-over-hydraulic power pack when combined with a rotary orienting tool. An orienting tool including a rotating member may preferably be utilized to rotate a bent sub or any other species of offset sub. The high pressure utilized to generate a sufficiently high torque on the rotating member to rotate while drilling has led to the development of a "balanced pressure" rotating member. Balancing the pressure on the rotating member avoids placing excessive force on thrust bearings supporting the rotating member. "Balanced pressure" is used to refer to a design wherein a helical surface receiving the pressure or force from the piston in one longitudinal direction is part of the member that also experiences a counter balancing force in the longitudinal direction due to the hydraulic fluid in the piston chamber. One way to attempt to express this "balanced pressure" design is to state that the piston chamber is located in the unit that contains the helical gears that mate with the helical gears on the piston.

A further feature of the high powered orient-while-drilling system comprises the use of helical gears. The piston imparting rotational movement to a rotating member to orient an offset joint (such as a bent sub) preferably uses helical gears mating with similar gears on the rotating member, in lieu of a lug or key in helical slot system. Helical gears transmit rotational movement to the rotating member. Helical gears can be viewed as a key in helical slot system, and vice versa, wherein the contact surface area between the key and slot has been substantially extended.

A further inventive aspect of the orient-while-drilling system comprises the arrangement of the tool modules in the bottomhole assembly. The orient-while-drilling system places the steering tool and instrument module, including non-magnetic collars if used, above the power pack and orienting system. The orienting tools are placed proximate to or next to the motor and bit or next to a bent sub followed by a motor and bit. Locating the orienting tool near the motor and bent sub has mechanical advantages in terms of rotating an offset joint, or bent sub, against frictional and drag forces.

In the B J Nowsco system although preferably the steering tool is located uphole from the orienting tool, it is yet connected to a rotating member of the orienting tool such that the steering tool rotates with the rotating member. By such means the steering tool tracks the rotation or orientation of an offset joint or bent sub. A quick release tool is preferably connected between a coiled tubing grapple connect and the steering tool and instrument module assembly. An orienting tool assembly may include the DC motors and hydraulic pumps, a circulating valve if operated off the hydraulic pumps, and the orienting tool or tools. A bent housing or other offset joint may be located immediately below the orienting tool or in or associated with the motor and bent housing. A current belief in the industry is that it is necessary to locate the steering tool as close as possible to the bit. It is the experience of the present inventors that greater advantage is achieved by locating the orienting tool adjacent the motor and bit.

An electric line preferably feeds the DC motors of the power pack. The electric line could also power a release tool. Preferably lines also exist to provide for the real-time communication of data from the steering tool, although other communication means are known and can be used. Real-time surface monitoring of downhole data permits joystick drilling. A feedback control loop can govern the rotating and orienting while drilling.

The orient-while-drilling system is capable of rotating in either direction to any degree, limited only by the piston stroke (in a preferred embodiment up to 400°) while drilling, at any time. In practice, corrections would probably be made only when the deviation appeared larger than the noise in the steering data. With the orient-while-drilling system the operator is free to manage the weight on bit in order to suit other needs. The weight on bit need not be managed in order to fine tune the orientation of the offset joint or bent sub.

The availability of a downhole electric-over-hydraulic power pack capable of generating high pressure makes available a hydraulic system capable of adjusting the degree of offset of an offset joint, or in terms of a bent sub, the bend angle. The hydraulic system of the power pack could also be utilized to operate a centralizer, including a centralizer with an adjustable diameter which could function as an anchor.

To review uses for the bottomhole assembly incorporating the downhole electric-over-hydraulic power pack, the hydraulic power can be used to set any valve or combination of valves, not just a single function circulation valve. The hydraulic power from the power pack can be used to hydraulically operate an offset centralizer or a hydraulically operated coaxial centralizer. The coaxial centralizer could be of hydraulically variable diameter. A hydraulically operated variable diameter centralizer could be used to anchor the tool through the wellbore in addition to merely centralizing. The downhole electric-over-hydraulic power pack can also be used to set compression tight mechanical packers. The bottomhole assembly, although adapted to be used with coil tubing, is not limited to coil tubing. It could also be advantageously used in many situations with jointed pipe.

An orient-while-drilling system offers a geo-steering method that need not be tied to a predetermined path. The guidance for geo-steering may be result driven, may be real-time data driven, in addition to or in variance from a predetermined path or a predetermined endpoint. With true geo-steering, a predetermined path in a target reservoir may not exist. There may be a general idea as to where to go but the course may be drilled using instruments to follow the reservoir strata, or wheresoever that appears to lead in real-time, based upon real-time data. In the build section of a well a gamma signal can be used to identify rock strata as the build curve develops. The incoming gamma information may dictate adjusting the build design. To the extent a predetermined path exists, it is constantly being changed and modified, optimized and updated.

An alternate embodiment of the bottomhole assembly could include the placement of a check valve or a back pressure valve between the motor and the bit.

It is not necessary for an orienting tool to use rotation to align a bent housing or any other offset joint. Furthermore, rotation need not be imparted through the use of helical gears to translate longitudinal movement into rotation.

In the orient-while-drilling system the axial position of the bent housing is preferably continuously monitored. The spacial position of the bent housing may be periodically calculated. Continually monitoring the axial position of the bent housing allows the operator to correct the position of the bent housing in small increments, as soon as it exceeds an acceptable tolerance span. Such system minimizes large sudden changes of the wellbore which could lead to problems with the well later when it is lined or serviced. The spacial position of the bit is kept thereby more closely on line. Typically, when the spacial position of the bit is calculated, a new intermediate path is determined that merges with some original predetermined path or special target at some point distant from the current location of the bit. The drilling now continues as if the new intermediate path were the original predetermined path.

Although the directional drilling using coil tubing bottomhole assembly is capable of orienting when pulled off bottom, typically it is designed to orient on bottom in conjunction with drilling and preferably continually monitoring the axial position of the bent housing.

Strictly speaking a bent sub is rotated relative to the earth. The instruments in control are set up to measure and control the bent sub's rotation relative to the earth.

In the orient-while-drilling system the coil is held while drilling at the surface to control the weight on the drill bit, but not the axial rotation of the coil. When there is weight on bit, the coil collapses into a spiral downhole that provides a friction lock, preventing rotating of the upper portion of the coil. Given such friction lock, there is no need to hold the tubing against axial rotation at the surface during orienting-while-drilling maneuvers. If the bit were rotated while pulled off bottom, the tubing might likely have to be held against axial rotation at the surface.

In some circumstances the orienting-while-drilling system will also calculate bit position with respect to the earth while drilling.

What is claimed is the invention substantially as disclosed, including its inventive aspects singley and in combination.

EXAMPLE 1

Position of the Orienting Tool

Problem: How much torque is required to orient the toolface of a prior art drilling assembly compared to the instant design? Calculate frictional torque resisting the rotation of a DUCT BHA in open hole. Assume 3 point bending with forces applied at the extreme ends and middle of the BHA. Only the lower portion of the BHA rotates.

Dimensions

BHA:

Length: overall 70 ft rotating part (a) 15 ft {NOWSCO}

(b) 35 ft {prior art}

OD: 3.125"

ID: 2.5"

Hole:

ID: 4.75"

Radius of curvature: 80 m

Coefficient of friction between BHA and hole: 0.30

Axial load:

(a)

(b) 3000 lbf

Results

The torques required to overcome frictional drag are as follows:

(a) Instant Design BHA: 2–30 ft lb (b) Prior Art: 20–300 ft lb

Discussion of Example

The reason for the large spread in the predicted prior art results arises from the much higher probability that their BHA will have to rotate at two contact points instead of one. If the central section of the BHA has to rotate then it encounters a large bearing force against the hole. Since the contact points are highly variable in position the required torque is similarly variable. The location of the orienting tool of the instant design is chosen to avoid the need to rotate the middle section of the BHA.

Orienting While Drilling

The instant orienting tool is designed to provide sufficient torque allow toolface adjustments to be made while the drill bit is working. This requires torques in the range 300–1000 ft lb. The adjustment is infinitely variable in both right and left hand directions. Drilling fluid can be circulated continuously during orienting adjustments so that the drilling process is not interrupted. The prior art tool appears to be unable to produce torques of the magnitude needed for continuously drilling. This is due to its reliance on the working pressure difference between the inside and outside of the tool e.g. typically 1000 psi and the cessation of drilling fluid flow required for resetting the tool. The toolface position is changed in 10 degree increments.

Actuator Design

The instant design is powered by a closed hydraulic system developing typically six times more differential pressure than the prior art tool. Motive power is electric. The prior art design is dependent on the drill motor and bit differential pressure. The instant design makes use of helical teeth or slots in both designs.

Steering Tool

The instant design is operable with a variety of steering tool packages, some of which have been in service for more than 10 years.

Circulating Valve

The instant design contains two methods for bypassing the drill motor assembly.

Bursting Disc: an over pressure rupture disc

A servo controlled 3 way valve which simultaneously opens a bypass port and shuts off drilling fluid from the drill motor assembly.

This feature is essential to the reliability of open hole drilling with low circulation rates. The prior art tool does not have this function.

Safety Release Joint

A surface controlled device for separating the BHA in two parts while also recovering the steering tool assembly. This feature is not included in the prior art design.

Measurement of Downhole Pressures

The instant design includes 2 pressure measuring elements, analogue to digital signal conversion and a multiplexor for transmission of the pressure valves to a surface recording/display package. The prior art tool does not have this function.

Orienting Tool

The rotary actuator used in the Nowsco directional drilling tool still has the highest torque capability of any downhole rotary actuator. This is beneficial as it allows the orienting tool (which includes the rotary actuator) to overcome reactive torques of large downhole motors as well as severe friction drag resulting from the ever tightening build radii requested by our customers.

The use of rotary actuators is not new, indeed our actuator bears several features in common with some surface devices. What makes our tool unique is its very high torque output compared with its diameter. There is one design concept that makes this possible. That is the pressure balancing of the actuator piston. Traditional actuators use large thrust bearings to counteract the large axial forces, developed hydraulically, translated into rotary torque by spiral gears or keys. This axial thrust is so large that it becomes very difficult to fit in bearings capable of handling the load. Various designs have been employed historically to convert axial force into rotary torque. In our case the axial force is developed by hydraulic pressure. It has always been a challenge to generate large torques within a compact diameter, and within a compact length. The two design problems to be overcome are first how to handle the large torque, in our case handled by precision helical gears, and second, how to handle large axial force.

Our invention solves the second problem, to my knowledge uniquely. We construct a pressure balanced actuator shaft. This is achieved by skillfully designing shaft and piston sealing diameters to balance the axial forces on the shaft generated by pressure versus those generated by torque on the helical gears. (A fairly complex equation can be presented showing the relationship employed to determine the diameters required for pressure balance). This reduces the axial load component reacted by a rotary thrust bearing by a factor of about 10:1. This in turn, allows us to build much more compact actuators.

Pressure Balance Definition

Pressure balancing refers to the method of minimizing any axial force imparted on the rotating actuator shaft, relative to the non-rotating housing. In essence, this requires that the pressure cavity used to hold the actuator piston is in the same component as the spiral grove used to induce rotary motion of the shaft. For example, if the piston is housed within a pressure cavity within the shaft, then the spiral groove used to generate torque must also be on the shaft, not in the housing. If the piston is housed in a pressure cavity in the housing, then the spiral groove must be placed in the housing, not on the rotating shaft.

The shown embodiments show the combined use of a straight groove and a spiral groove. It is also possible to achieve pressure balance using two spiral grooves, and a piston housed in a cavity that is intermediate to the shaft and the housing.

Minimizing the axial force on the rotating shaft relative to the fixed housing allows much larger pressures and torques to be derived from the same compact unit, as much smaller rotating thrust bearings are required.

The diagrams show a peg and groove arrangement. The preferred embodiment is to use straight and helical gears, rather than pegs and grooves.

Circulating Valve

This invention is a sub component of the novel directional drilling system for coiled tubing. A circulating valve is a valve that can be opened and closed. When it is closed, all the flow is diverted down the tool string, when it is open, the flow is diverted through a port in the outside of the tool.

Circulating valves were commercially available at the time of this invention. However, there were no circulating valves operated by hydraulic pressure. The Nowsco circulating valve uses a downhole hydraulic pump that can drive traditional hydraulic devices. The use of such a hydraulic drive mechanism has not been previously utilized for the operation of a downhole circulating valve.

The original coil tubing drilling strings all had a weakness in that they did not have circulating valves. The circulating valve is required for drilling operations for one or both of the following reasons:

To permit circulation downhole without operating the downhole drilling motor;

To permit circulating flow rates in excess of what can be safely pumped through the downhole drilling motor to move the drill cuttings up the wellbore.

The instant invention allowed a circulating valve to be incorporated into the drill string in a simple and efficient manner using hydraulic pressure generated by downhole hydraulic pumps. The use of hydraulic pressure allows for reliable operation as simple, proven hydraulic valving can be used to control the device.

The present inventors had the first system incorporating a circulating valve. However, other companies have now also developed circulating valves. These competing valves, to my knowledge, are not operated off hydraulic circuits and will likely prove to be less reliable, or less flexible in operation.

Adjustable Offset Joint

The invention is a new method of achieving a downhole adjustable bent sub for mutli-lateral operations including directional drilling.

The method involves using a downhole pump, used to generate high hydraulic pressures. This hydraulic pressure is then converted to a force used to either straighten, or bend, an adjustable bent housing, or else adjust the offset on an offset centralizer.

The exact mechanism of converting pressure to force, required to achieve movement of the bent sub, can take many forms. It will require either an angled rotary actuator, a rotary swash plate or a linear drive moving a hinged joint, or else an offset centralizer, adjustable by either linear or rotary motion of the centralizer.

The ideal embodiment will provide for a tool with hydraulic feed back, showing whether the tool has changed position or not, and will not permit the possibility of adopting a high side other than that set up on surface, even if the tool malfunctions.

Drilling

Directional drilling has become the most common form of drilling. Further trends have been towards horizontal wells with smaller holes and with tighter build radii. There has also been a trend towards drilling with coiled tubing.

A typical horizontal well consists of two parts, first the build section, which is a curve drilled to take the well trajectory from basically vertical to basically horizontal. The second is the horizontal section itself. These two sections require different tool functions. In the build, the goal is to build angle quickly. The horizontal section requires mostly the maintenance of a straight hole, although some corrections in both azimuth and inclination are invariably required.

Presently, the drilling assembly has to be tripped out of hole so that it can be configured for one of the two drilling sections. This invention would permit both sections to be drilled in a single trip, adjusting the tool configuration downhole, when drilling switches from the build section to the horizontal section. This will save much time in the drilling program. Systems have been developed that attempt to achieve this function, but none so far are commercially and technically viable.

Several other problems associated with directional drilling are solved by this invention. The tool string can be run in and out of the well in the straight position, reducing the risk of the tool hanging up and reducing the size of the surface equipment required. Also more control of the build section can be achieved as the build rate can be adjusted as the build is drilled, for example by drilling a portion of the build with the bent housing straightened.

The novelty with this invention is the use of high pressure hydraulics downhole to achieve the functionality. Using hydraulics allows the generation of large forces, required to operate the tool, and also permits the use of standard hydraulic valving to fulfill feed back and control options.

The instant inventors already have experience in downhole hydraulics, as our orienter and circulating valve are hydraulically driven. Our orienter, unlike all others, is placed directly above the drill motor, meaning that we, unlike others, can easily utilize our orienter hydraulics to operate an adjustable bent sub positioned directly above the motor.

SUMMARY OF THE INVENTION

The bottomhole assembly, including the preferred embodiments of the above described tools or subs, was developed initially to operate with a downhole drilling motor. However, in some configurations the BHA is applicable to, and can be advantageously used for, other well operations and applications. The invention, therefore, is not limited to drilling applications.

The BHA was also designed particularly to be connected to and used with coiled tubing. Coiled tubing is particularly favorable for continuous operations, such as orienting while drilling. However, the bottomhole assembly as designed could be used with tubulars, or jointed pipe, at least in some circumstances. Thus, the invention need not be limited to use with coiled tubing.

In operation, a BHA power pack tool of the instant invention would be connected to a source of electricity at the surface. Preferably electric power conveyed by an electric line run through tubing would power a downhole electric motor or motors. Preferably, the electric motors are reversible, DC and structured to comprise a series of motors. For certain operations, such as orienting while drilling, the power pack should generate at least 700 foot pounds of torque in connection with rotating an orienting tool. A hydraulic pump attached both above and below the electric motor(s) makes possible the actuation of double-acting pistons. Clutches can slip the hydraulic pump out of service if riot being used.

When the BHA is used for drilling, the BHA preferably combines its tools such that a steering tool is attached above a power pack which is attached above an orienting tool. The orienting tool is then advantageously located toward the bottom of the BHA, proximate to where attachment is made to a downhole drilling motor and bit and offset joint. Preferably, the orienting tool is located on the bottomhole assembly in proximity to an offset joint. The drilling motor might intervene between the orienting tool and the offset joint, depending upon the motor/offset joint/bit configuration being used. Frequently, the motor/joint/bit unit is leased from third parties. The orienting tool preferably would have two members that in operation rotate with respect to each other. The first member is be adapted to be connected in fixed rotational or axial position to a connecting sub that connects the BHA to the tubing. The second member is adapted to be connected in fixed rotational or axial position to a portion of a steering tool. In operation, thus, this portion of the steering tool and member of the orienting tool is connected in fixed rotational or axial position to a rotating offset joint. Preferably, the BHA includes a release tool attached between a sub connecting the BHA to the tubing and a steering tool. The release tool could be electrically powered. In operation, a release tool so situated can separate the tubing from the bulk of the BHA. Preferably, also the BHA includes a circulating valve. The preferred location for a circulating valve is above the orienting tool for drilling operations. Preferred embodiments of a BHA might also include an adjustable centralizer, and preferred embodiments used for drilling might include an adjustable offset joint. In operation, a downhole adjustable centralizer could be adjusted by using the hydraulics from a power pack. Such an adjustable centralizer might be structured to be adjusted to provide an anchor for the BHA. In operation, an adjustable offset joint could be adjusted downhole to vary the bend angle of the drilling, and could include the option of straight drilling, without tripping out of the hole. An adjustable offset joint could also adopt a straight orientation for running the BHA into and out of the hole. An adjustable offset joint would preferably be located between the orienting tool and the motor.

In operation, an important aspect of the BHA for downhole drilling includes means for communicating wellbore and drilling data to a surface facility. The preferred means of communicating would be by electric line running through tubing. Other reliable means of communicating downhole data, however, exist. The communicating of real time downhole data facilitates orienting while drilling. "Real time" data, as that term is used herein, may be communicated essentially continuously and essentially contemporaneously with its collection. Alternately, "real time" data might also be packaged and communicated in bursts, lagging a few seconds behind the data's time of collection. Real time data preferably includes data relating to the axial location of the offset joint, the spacial location of the BHA, and formation and/or reservoir data. Data whose communication lags collection by several minutes would not be regarded as real time.

The invention includes a BHA for use with a downhole drilling motor that includes an orienting tool having a member that defines an end of a piston chamber opposite the piston. This member also has a helical element mating with an element of the piston operable in the chamber to create a balanced pressure orienting tool. The orienting tool has a second member with respect to which the first member notates and preferably the relative rotation is bidirectional and up to at least 360° in response to movement of a double-acting piston. Preferably also, the rotation is not limited to fixed steps.

For downhole drilling motor operations, the BHA may include a circulating valve structured to divert a portion of fluid communicated down the drill string, such as the drilling fluid. The fluid is to be diverted around the drilling motor and into the wellbore. An electrically powered hydraulic pump preferably operates such a circulating valve.

A BHA for use with a drill string and downhole drilling motor might include a downhole adjustable offset joint with the offset being adjusted in response to translational movement of a double acting piston. The piston could translate a nonaxially aligned shaft wherein the translation of such shaft creates an offset joint. Adjusting the degree of the offset involves selecting the position of the shaft. The translation of the piston is best activated by an electric-over-hydraulic pump attached to the BHA. Alternately, the degree of offset of an adjustable offset joint could be adjusted by means of two members that are pivotally attached to one another. The degree of offset would be a function of the pivotal relationship between the two elements. This pivotal relationship, in turn, could be governed by the movement of a piston in a chamber.

As mentioned above, the invention may include a bottomhole assembly that has a downhole adjustable centralizer. The centralizer could have a plurality of adjustable arms. Preferably, an electric-over-hydraulic actuator in fluid communication with the piston would connect with the arms and adjust the diameter defined by the arms. Such an adjustable centralizer might provide arms with the capacity to adjust outward such that the centralizer could form a downhole anchor for the BHA. Preferably, the centralizer arms would adjust in response to the movement of a double-acting piston.

The invention is particularly directed to a method of directional drilling that comprises transmitting steering information from a BHA to a surface facility while drilling, determining a steering correction and rotating an offset joint while drilling.

The steering information could include a variety of information. However, some corrections could be based upon minimal information. Preferably, all steering information and downhole data would be processed by a computer facility. The steering information should include information relating to the axial orientation of the BHA. In particular, this information should relate to the axial orientation of an offset joint. The steering information should also include information relating to the spacial location of the BHA. This information may relate to the spacial location of the bit or to any other element along the BHA. Preferably, steering information also includes formation and/or reservoir data. The best steering strategy might be to follow some formation or the reservoir as opposed to any predetermined path, or to aim for a spacial target.

The instant method of directional drilling is particularly applicable to the use of coiled tubing as the drilling string. With coiled tubing as the drilling string, and with practicing orienting while drilling, the drilling need not be stopped to either add a joint to the drilling string or to effect an orientation change.

The steering information should be real time at least at important times, but may be batched and transmitted to the surface periodically, as opposed to substantially continuously, according to the best strategy for data communication with the equipment used.

Given the availability of computer processing of data, especially real time data, as well as reliable communication facilities, the data could be processed and the steering correction determined off-site, as in a central directional drilling facility, remote from the drilling location. In such a manner, one directional driller, and possibly one computer, could manager a plurality of directional drilling operations, even simultaneously.

Preferably, orienting while drilling includes powering a downhole electric-over-hydraulic motor attached to a BHA. The drilling includes operating a downhole drilling motor and drilling element attached to a BHA. Orienting typically includes relatively rotating two elements of an orienting tool. One element remains in fixed axial relationship to the offset joint. The other element remains in fixed axial relationship to the drilling string, or at least to the lower portion of the drilling string attached to the BHA. Drilling strings may well twist or torque between the BHA and the surface during drilling. Preferred orienting tools and methods of the present invention permit rotating an offset joint in varying amounts in two directions and impart temporarily a torque or rotation to at least the lower portion of the drill string while performing the orienting. In preferred embodiments, orienting includes maintaining a portion of the steering module in a fixed axial relationship with the offset joint.

The invention includes a method for orienting an offset joint of a BHA downhole. The orienting includes supplying electricity from the surface to power a downhole electric-over-hydraulic motor associated with a BHA. The method includes hydraulically translating a piston in a chamber in a BHA and converting longitudinal motion of the piston to an adjustment of orientation of an offset joint. The adjustment of orientation of the offset joint might include either adjustment in axial rotation of the offset or adjustment of the degree of offset of the offset joint, or both.

The present invention includes a method of drilling using a downhole motor attached to a BHA that includes the ability to circulate at least a portion of a drilling fluid to the wellbore at the BHA while bypassing the drilling motor. Preferably, the drilling would be performed with coiled tubing and the circulating would use a circulating valve. The invention also includes a method for centralizing a BHA, comprising hydraulically actuating a piston in the BHA and varying a pivot angle in a centralizer link arm in accordance with translational motion of the piston. The invention includes a method of directional drilling comprising hydraulically translating a piston in a chamber in a BHA and varying a degree of offset of an offset joint in accordance with the translation of the piston. The degree of offset might be varied by hydraulically powering a piston in the BHA to achieve a desired pivot angle between two elements in the BHA.

BRIEF DESCRIPTION OF THE DRAWINGS

The invention will be better understood and objects other than set forth above, will become apparent when consideration is given to the following detailed description thereof. Such description makes reference to the annexed drawings wherein:

FIG. 1 illustrates the power pack of a preferred embodiment in diagram form, illustrating in particular the arrangement of three electric DC motors in series, with a hydraulic pump placed above and below.

FIG. 2A illustrates one embodiment of a coiled tubing drilling directional BHA.

FIG. 7 illustrates, partially in cross section, an adjustable diameter centralizer/anchor embodiment.

FIG. 9 illustrates methodologies of the present invention.

DETAILED DESCRIPTION OF THE PREFERRED EMBODIMENTS

Figure 2B:
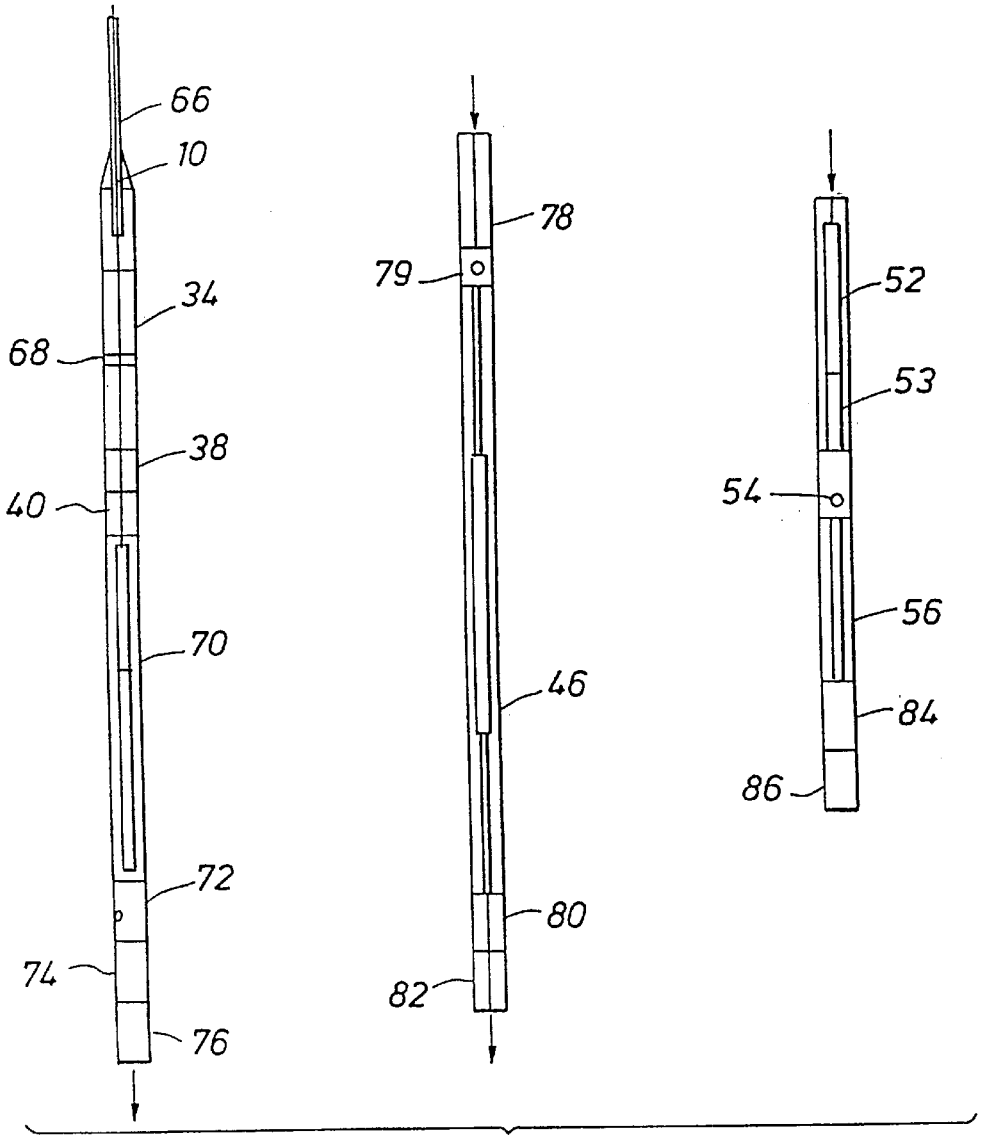
FIG. 2B illustrates a drilling assembly schematic of a second embodiment showing in particular how a BHA can be broken into modules.

FIG. 1 illustrates a preferred embodiment for a power pack of the instant invention. Three DC electric motors 12, 14 and 16 are situated in series along shaft 18 with hydraulic pump 20 attached to the shaft below the motors and hydraulic pump 22 attached to the shaft above the motors.

Electric line 10 powers electric motors 12, 14 and 16. Electric line 10 runs within bottomhole assembly (BHA) 32, indicated generally by dashed lines. Electric line 10 runs from BHA 32 up to a source of electric power at a surface facility. "Surface facility" should be understood generically as generally out of the wellbore. It includes whatever location is convenient to situate equipment to service the drilling. The surface facility arguably could be subsea.

Hydraulic pump 22 has a hydraulic line 30 and a suction line 28. Hydraulic pump 20 has a hydraulic line 24 and a suction line 26. Preferably both hydraulic pumps 20 and 22 would be provided with a clutch, as is known in the art. Preferably DC motors 12, 14 and 16 are reversible. When the motors run in a first direction, a clutch associated with one pump is slipped so that the motors operate only the other pump. The reverse is true when the motor is reversed. It will be appreciated that the arrangement of FIG. 1 permits the pair of hydraulic pumps to operate a double-acting piston. In preferred embodiments the hydraulic pumps can be in fluid communication with a variety of tools, valves, and actuators FIG. 2A illustrates one embodiment of a coiled tubing directional drilling BHA broken down into modules. The BHA is designed to run on coiled tubing. The top module comprises a grapple connect 34 attached to a cable anchor 36 and the top half of a universal connect/disconnect joint 38. The second module comprises the bottom half 40 of a universal connect/disconnect joint, check valves 42, release tool 44, steering tool including instrument modules and non-magnetic housing 46, and the top half 48 of a universal connect/disconnect joint. The third module comprises the bottom half 50 of a universal connect/disconnect joint, power pack 52 having DC motors and hydraulic pumps, more particularly illustrated in FIG. 1, circulating valve 54, orienting tool 56 and check valves 58. Appropriate subs will be used below check valves 58 to mate with the lower module of the bottomhole assembly comprising motor 60, bent housing 62 and bit 64. Frequently directional drilling bottomhole assemblies are designed to mate with a variety of manufacturers' motors, bent housings and bits.

FIG. 2B illustrates a slightly different embodiment of a BHA for use with a downhole drilling motor. Coiled tubing 66 is illustrated carrying electric line cable 10. FIG. 2B illustrates coiled tubing connector 34 and cable bulkhead 68. A quick connect device follows having upper element 38 and lower element 40. Element 70 includes a multiplexer and digital to analog converter, useful as is known in the art to package and communicate data to the surface. FIG. 2B also illustrates pressure sensors 72 followed by quick connect units 74 and 76 to finish a first module of a bottomhole assembly. The second module of a bottomhole assembly includes safety release 78 and steering tool 46 contained within a non-magnetic tube as is known in the art. The steering tool module is completed with quick connect devices 80 and 82 to finish the second module of the BHA. The third module of the BHA includes power pack 52 containing electric motors and hydraulic pumps as well as hydraulic control valves 53 and circulating valve 54. The power pack is followed in the assembly with orienting tool 56 attached to quick connector units 84 and 86.

Figure 3:
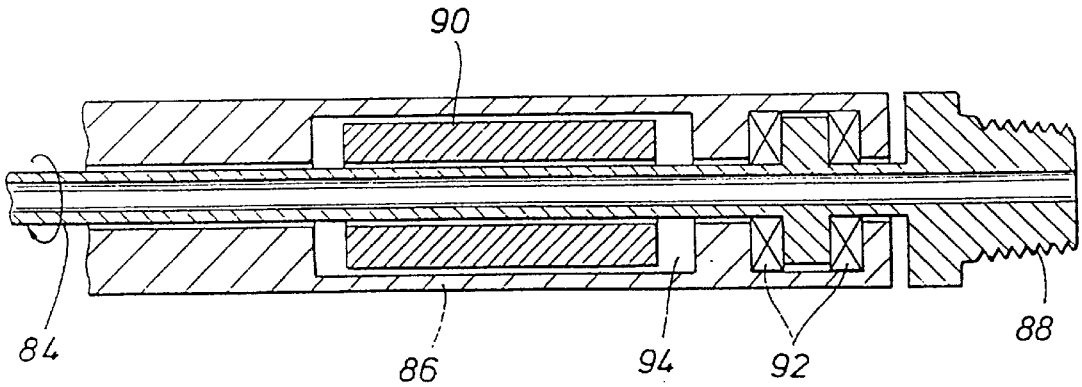
FIG. 3 offers a schematic of an orienting tool illustrating in cross section a rotating shaft connected to a steering tool above the orienting tool and illustrating the placement of thrust bearings.

FIG. 3 illustrates the feature of an embodiment of the present invention in which an orienting tool contains a shaft that is designed to connect through the bottomhole assembly and through the power pack and to an element of the steering tool. The lower end of the orienting tool is designed to connect to the motor and offset joint, such as bent housing or bent sub, and drilling element such as a bit. In such a manner the offset joint can be connected fixedly in the axial direction with portions of the steering tool. In such manner, the axial orientation of the offset joint can be monitored by the steering unit. FIG. 3 illustrates orienter shaft 84 structured to extend uphole in the bottomhole assembly. The downhole end of the orienter shaft 84 is adapted to attach, as by screwing, into a motor/bent housing, bent sub/bit unit.

A downhole drilling motor and bit are frequently rented from third-party providers. The unit may include an offset joint such as a bent housing for the motor or bent sub. Piston 90 is illustrated as translating in piston chamber 94. Piston 90 is intended to represent a double-acting piston. Thrust bearings 92 help secure shaft 84 in orienter housing 86.

Figure 4A:
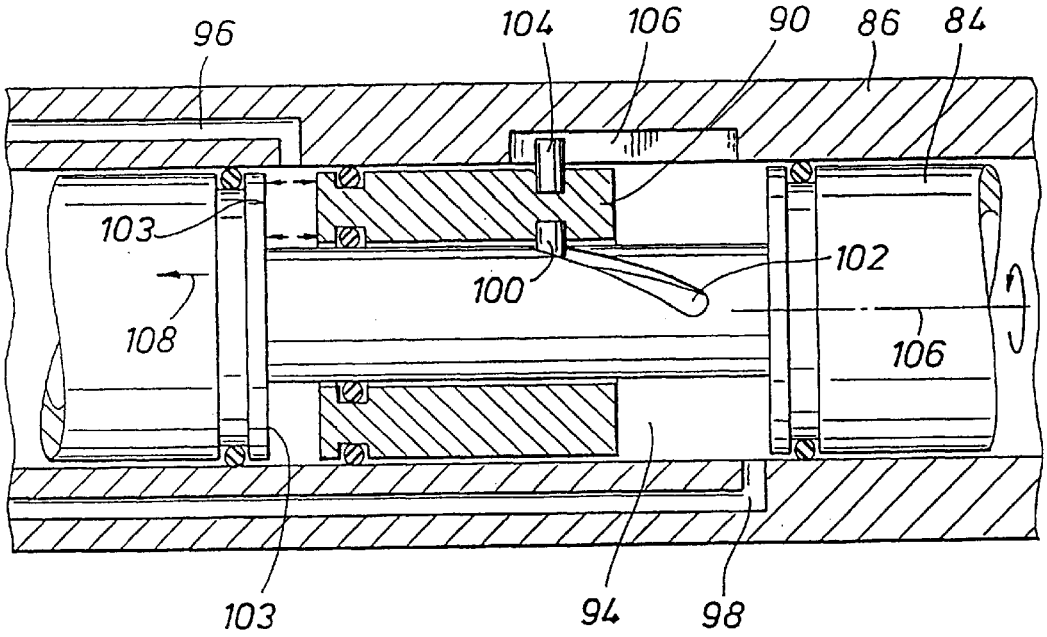
FIG. 4A illustrates in cross section a pressure balanced system for an orienting tool.

FIG. 4A illustrates a pressure balanced system for an orienting tool. In FIG. 4A shaft 84 is illustrated as rotating and rotatable within housing 86. Hydraulic lines 96 and 98 provide for pressuring both sides of piston 90 in chamber 94. Appropriate seals are provided to define the pressure chambers. Piston 90 is restricted to translational movement by the position of lug 104 in vertical slot 106. Piston lug 100 moves in helical slot 102 of shaft 84. In preferred embodiments lug 100 and helical slot 102 would be helical gears, as is known in the art. As pressure flows in hydraulic line 96 to the left section of chamber 94, piston 90 is forced down or to the right. In the upper or left hand portion of chamber 94 hydraulic force 108 presses against a shoulder 103 of shaft 84. An equal force presses downward against piston 90 driving lug 100 downward against helical slot 102. Ignoring friction, the downward force exerted by lug 100 against helical slot 102 on rotating shaft 84 essentially cancels the upward force 108 exerted by the pressure in the upper or left hand portion of chamber 94 by the hydraulic fluid entering through line 96 on shoulder 103. Piston 90 moves downward, or to the right, rotating shaft 84 by virtue of the movement of lug or gear 100 in slot or gear 102. Hydraulic fluid in the lower portion of chamber 94 can be circulated out via hydraulic fluid return line 98.

Figure 4B:
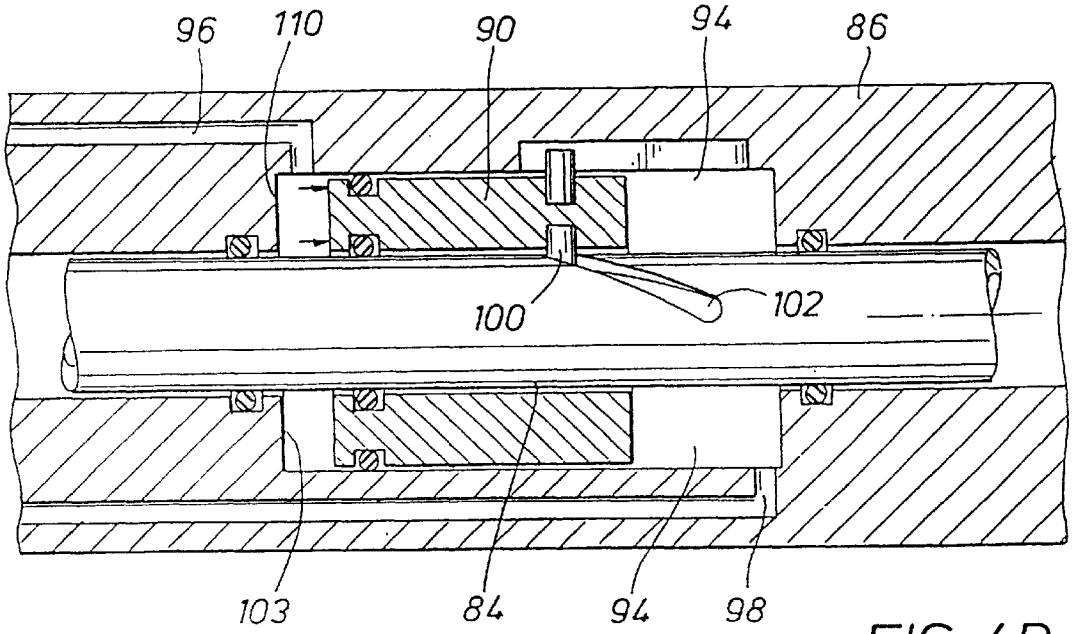
FIG. 4B illustrates in cross section a pressure imbalanced system in a similar orienting tool.

FIG. 4B, for contrast, shows a pressure imbalanced system for an orienting tool. In FIG. 4B hydraulic fluid pressuring the upper or left hand side of chamber 94 exerts downward force on piston 90 and an upward force on shoulder 110 of nonrotating housing element 86. Again, the force of the hydraulics from line 96 forces piston 90 down whereby lug 100 moves in helical slot 102 rotating shaft 84. However, in the embodiment of FIG. 4B, because hydraulic chamber 90 and helical slot 102 opposite end 110 are not created in the same housing element, there is not a counterbalancing force against rotating shaft 84 to the left, or upward, to counterbalance the downward force of lug 100 against the side walls of helical slot 102. Thus, significant force will be placed upon thrust bearings to be located at the end of rotating shaft 84, as is known in the art. As illustrated in FIG. 3, thrust bearings 92 could be placed in compression.

Figure 5A:
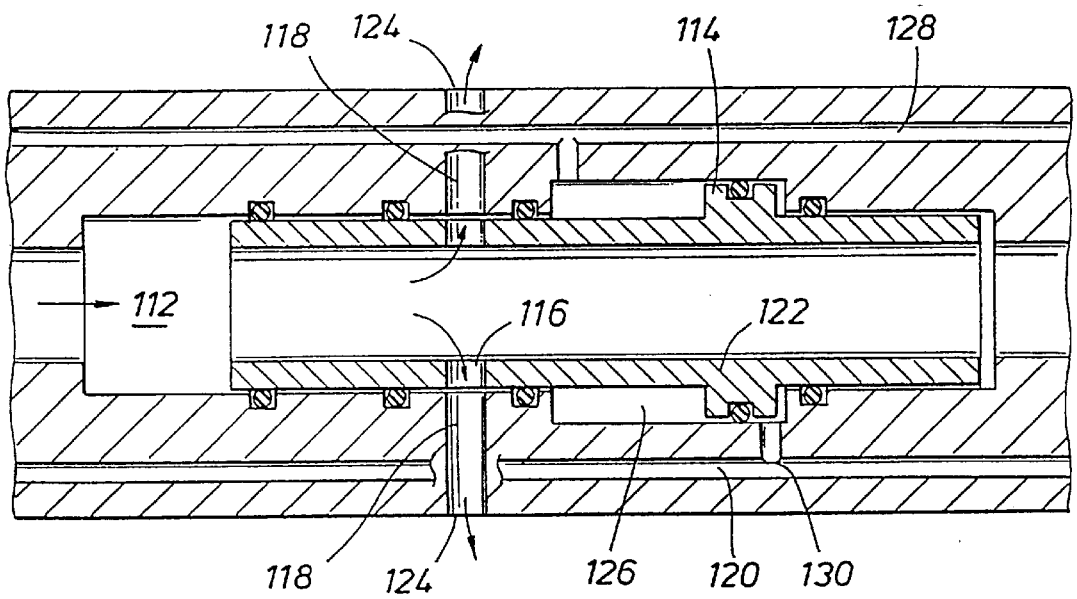
FIG. 5A illustrates in cross section a circulating valve, open position.

FIG. 5A illustrates an embodiment of a circulating valve-open position of the present invention. FIG. 5A illustrates drill fluid 112 passing through the center of the circulating valve. Within the circulating valve piston 114 translates within chamber 126. As illustrated, piston 114 is a double-acting piston receiving hydraulic pressure on the one hand from line 128 to the left or upper side of chamber 126 and receiving hydraulic pressure from line 130 to the right or lower side of chamber 126. As illustrated in FIG. 5A hydraulic pressure through line 128 and into the left side of chamber 126 has forced piston 114 and shaft 122 down or to the right. In such a configuration port 116 lines up with port 118 and apperture 124. Drilling fluid 112 will follow the path of least resistance and egress from the center of the circulating valve, in its open position out ports 116, 118 and apperture 124 to a portion of the wellbore outside of the circulating valve.

Figure 5B:
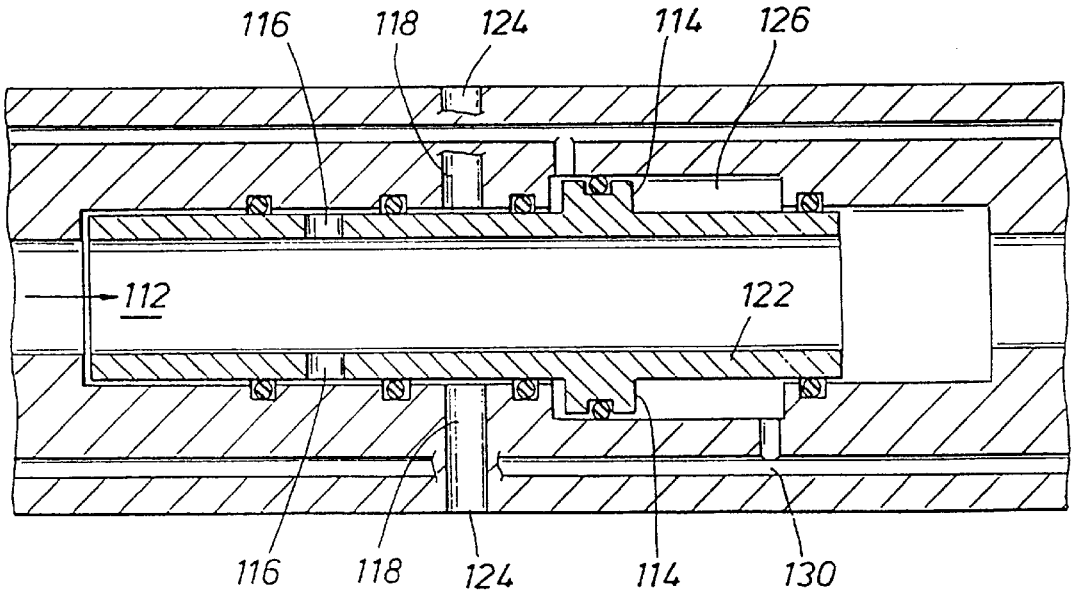
FIG. 5B illustrates in cross section the circulating valve of FIG. 5A in closed position.

In FIG. 5B hydraulic fluid from line 130 has pressured piston 114 and shaft 122 to the upward or left-most position by applying pressure on piston 114 in the right or lower portion of chamber 126. In this closed position port 116 does not line up with port 118 and apperture 124. Thus, drill fluid proceeding through the center of the circulating valve may not egress out apperture 124 to the wellbore outside of the circulating valve.

Figure 5C:
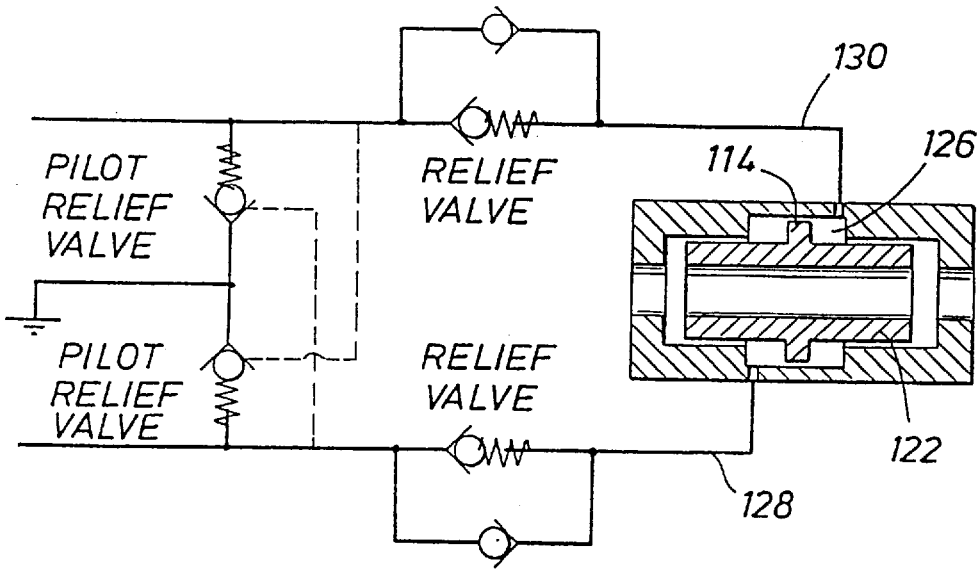
FIG. 5C illustrates, partially in cross section, a hydraulic circuit for a circulating valve.

FIG. 5C illustrates an embodiment of a hydraulic circuit for operating a circulating valve.

Figure 6A:
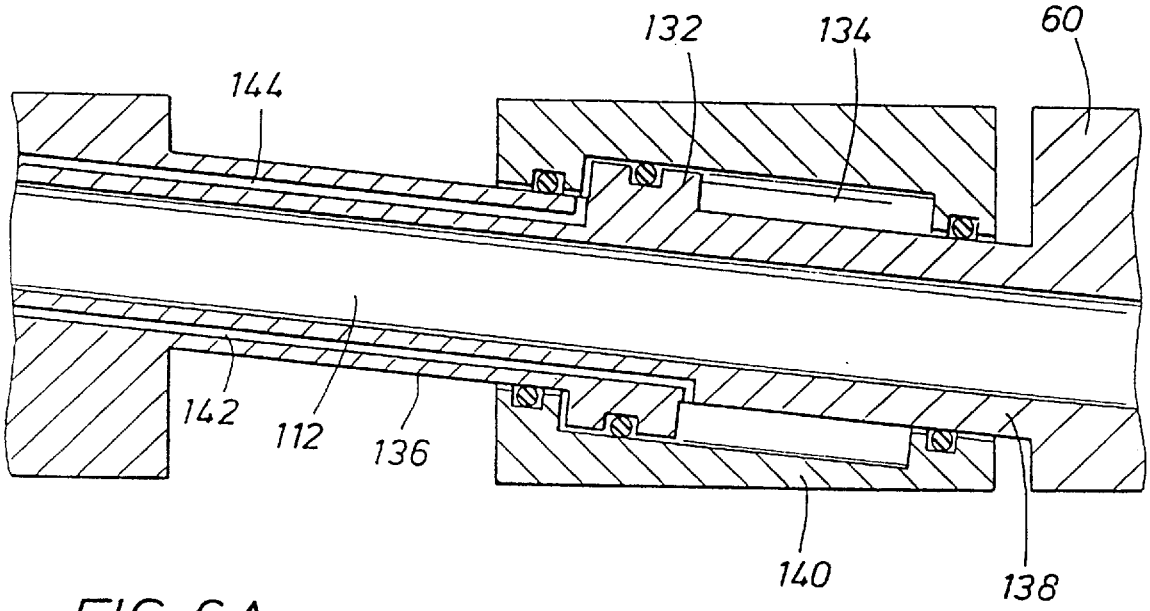
FIG. 6A illustrates a hydraulically adjustable offset centralizer that could form an offset joint for directional drilling.

FIG. 6A illustrates a hydraulically adjustable offset joint, or offset centralizer. Double-acting piston 132 in chamber 134 moves offset centralizer or offset joint 140 up and to the left, creating an offset joint. In its lower or rightmost position, as illustrated in FIG. 6A, offset centralizer 140 creates no offset joint. Hydraulic fluid through hydraulic lines 142 and 144 move piston 132 in chamber 134.

Figure 6B:
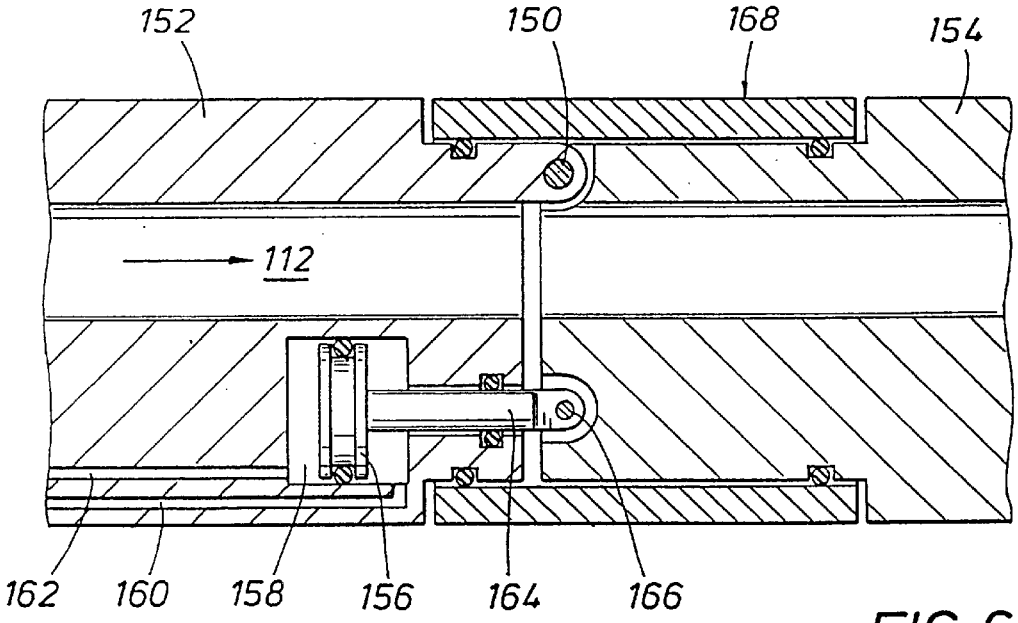
FIG. 6B illustrates an adjustable bent sub embodiment of an offset joint, partially in cross section.

FIG. 6B illustrates another embodiment of an adjustable bent sub or adjustable offset joint. In FIG. 6B housing element 154 is attached by pivot 150 to housing element 152. Flexible or loose-fitting sleeve 168 surrounds the pivoted joint. Drill fluid 112 flows through the center of both element 152 and element 154. Piston 156 moves in chamber 158. Again, a double-acting piston 156 is created by virtue of hydraulic line 162 and hydraulic line 160 powering piston 156 both ways within chamber 158. Piston 156 connects to shaft 164 which has a pivoted connection 166 with element 154. As piston 156 moves downward, or to the right, element 154 will rotate outward or toward the top of FIG. 6B, creating an offset joint. The rotation is by virtue of pivoted connection 150.

Figure 6C:
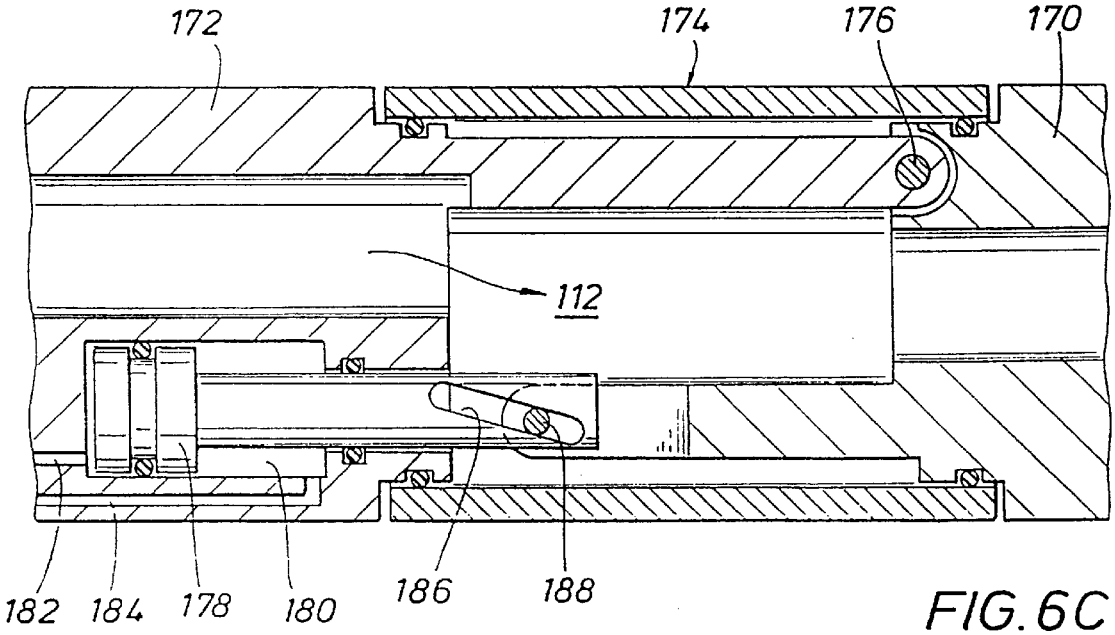
FIG. 6C illustrates another adjustable bent sub embodiment of an offset joint, partially in cross section.

FIG. 6C illustrates a further embodiment of an adjustable offset joint. In the embodiment of FIG. 6C element 172 is connected by pivot 176 to lower element 170. Again, a flexible or loose-fitting sleeve 174 fits around the pivot joint. Drill fluid 112 flows through the center of both elements. Piston 178 moves in chamber 180. Again, piston 178 is a double-acting piston being powered by hydraulic fluid in lines 182 and 184. As piston 178 translates in chamber 180 angled slot 176 moves over lug 188 of element 170. As piston 178 moves down or to the right angled slot 186 forces lug 188 to the outside of the tool. This force tends to rotate tool element 170 around pivot 176 upward in the drawing to create an offset joint.

FIG. 7 illustrates an adjustable diameter centralizer/anchor embodiment for use with a BHA. Piston 196 moves in chamber 202 of centralizer element 204. Drill fluid 112 passes through the center of the centralizer. Element 204 is free in turn to translate in annular chamber 206 of element 208. Fluid from hydraulic line 198 moves double-acting piston 196 downward or to the right in chamber 202. As piston 196 hits against the downward or lower shoulder of element 202 it moves element 202 downward or to the right in annular chamber 206. Such movement to the right moves out pivoted centralizer link arms 194 and 192. Preferably there would be a plurality of such two link mechanisms.

Figure 8:
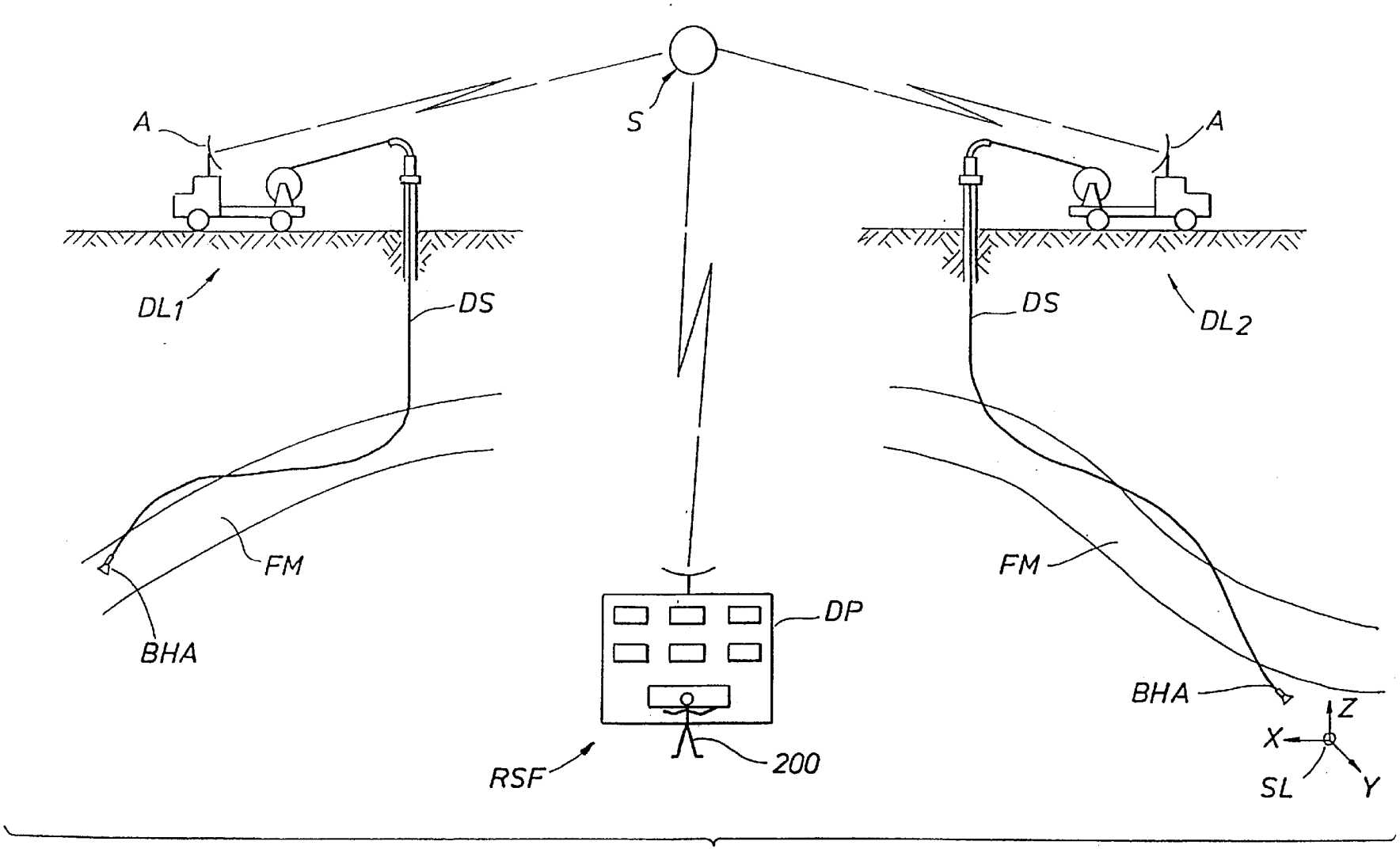
FIG. 8 illustrates methods of directional drilling where a surface facility is remote from a plurality of drilling locations and drilling is targeted to spacial coordinates or by formation data.

FIG. 8 illustrates various aspects of preferred embodiments of the present invention. First, FIG. 8 illustrates two drilling locations, $DL_1$ and $DL_2$. Steering information from bottomhole assemblies BHA is transmitted to the surface.

Such steering data is preferably transmitted by wireline inside of coiled tubing used for directional drilling. However, other means of communication of data are known. The data is preferably transmitted substantially contemporaneously with its collection. That is, the data is preferably transmitted either continuously or batched for transmission every few seconds. FIG. 8 illustrates that at the surface data is transmitted from antennas A at the drilling locations via satellite S to a remote surface facility RSF. There directional driller 200 can make orienting decisions relating to either or both drilling locations. The data is preferably processed in a data processor DP located at the remote surface facility.

During important times at a drilling location, data is preferably transmitted essentially real time to a remote surface facility RSF. Since drilling can take place over days and weeks, however, there will be slow times even in directional drilling. During these times the data may be batched and sent only periodically to the remote surface facility, such as every thirty minutes or so, to minimize costs.

In preferred embodiments of the invention orienting decisions and corrections will be made to optimize the drilling. It is envisioned that preferred orienting strategies include aiming and reaiming for a target spacial location, illustrated as location SL in drilling location $DL_2$, location SL being indicated as having an X,Y and Z coordinate. Alternately, at drilling location $DL_1$, the orienting decisions might be premised upon a desire to listen to formation data and seek out and follow a reservoir.

The availability of reliable communications from remote locations makes possible the managing of at least a part of the directional drilling decisions by directional drillor located at a central surface facility.

FIG. 9 illustrates a further aspect of the methodology of the present invention. FIG. 9 illustrates directional drilling using coiled tubing. Bit B is illustrated as rotating at the bottom of the hole. Bottomhole assembly BHA is illustrated as having bent sub BS. While bent sub is rotated by bottomhole assembly BHA in direction 201 while drilling, the lower portion of coiled tubing CT will be torqued or rotated in an opposite direction 202. When bottomhole assembly BHA ceases applying torque to bent sub BS to rotate in direction 201 while drilling, then coiled tubing CT should unwind in a direction opposite to direction 202 thereby further orienting bent sub BS in direction 201. Because of the helixing of a drill string of coiled tubing CT in wellbore WB, any temporary torque applied to a lower section of coiled tubing CT is not anticipated to cause any rotation at the upper levels of coiled tubing CT in wellbore WB.

Rotating bit B is accepted by those in the art to have already placed a certain amount of rotation on coiled tubing CT in wellbore WB. The torque or rotation placed on the tubing due to drilling alone should be opposite to the direction of the rotation of the bit. Orienting or rotating while drilling must allow for and account for the torque on the coiled tubing due to the drilling of the bit as well as the temporary additional torque on the tubing due to rotating the rotating tool and offset joint while drilling. Resistance of the wellbore against rotation of the bent sub is similar to resistance of the bottomhole of the well to rotation of the bit. Both can place a torque on a drill string, in particular on a coiled tubing drill string.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A bottomhole assembly (BHA) in fluid communication with a drilling string and a downhole drilling motor, comprising:

a circulating valve structured to divert at least a portion of motive fluid from the downhole drilling motor into a wellbore;

a downhole electric powered hydraulic pump;

wherein the pump operates the circulating valve; and a downhole orienting tool located below a downhole steering tool.

2. The apparatus of claim 1 wherein the drilling string comprises coiled tubing.

3. The bottomhole assembly (BHA) of claim 1 wherein the steering tool is connected to the orienting tool so as to rotate with portions of the orienting tool relative to the electric powered hydraulic pump.

4. The apparatus of claim 3 wherein the tubing string includes coiled tubing.

5. The apparatus of claims 1 or 3 wherein the circulating valve is located above the orienting tool.

6. The apparatus of claims 1 or 3 that includes a downhole power pack located above the orienting tool.

7. The apparatus of claim 6 wherein the power pack is located below the steering tool.

8. The apparatus of claims 1 or 3 wherein the orienting tool is connected to the tubing string and includes a first member that rotates with respect to the tubing string and that defines an end of a piston chamber opposite a piston, the first member having a helical element mating with a translating element of a piston operable in the chamber.

9. The apparatus of claim 8 wherein the orienting tool includes a second member rotatable bi-directionally with respect to the first member, up to at least approximately 360°.

10. The apparatus of claim 8 wherein the piston includes a double acting piston and the helical element includes a helical gear.

11. The apparatus of claims 1 or 3 that includes a downhole adjustable offset joint.

12. The apparatus of claim 11 wherein the offset joint is adjustable in response to translational movement of a double acting piston in the BHA.

13. The apparatus of claim 12 wherein the piston is activated by at least one downhole hydraulic pump activated by at least one downhole electric motor.

14. A bottomhole assembly (BHA) in fluid communication with a coiled tubing string, comprising:

a downhole drilling motor in fluid communication with a motive fluid;

a circulating valve structured in combination with the downhole drilling motor to divert at least a portion of the motive fluid from the downhole motor;

a downhole orienting tool;

a downhole power pack structured in combination with the circulating valve and the orienting tool to power the valve and tool, and including at least one electric motor and a downhole steering tool.

15. The apparatus of claim 14 wherein the downhole steering tool is connected to rotate with portions of the orienting tool and with respect to the drilling string.

16. The apparatus of claim 14 that includes the steering tool located above the orienting tool.

17. A bottomhole assembly (BHA) in fluid communication with a tubing string, comprising:

a downhole drilling motor in fluid communication with a motive fluid;

a circulating valve responsive to a valve fluid;

valve fluid pressure at least partially independent of motive fluid pressure;

the circulating valve structured in combination with the downhole drilling motor to divert at least a portion of the motive fluid from the downhole motor; and a downhole power pack structured in combination with the circulating valve to pressurize valve fluid, wherein the power pack includes at least one hydraulic pump activated by multiple electric motors connected in series.

18. The apparatus of claim 17 wherein the tubing includes coiled tubing.

19. The apparatus of claim 17 wherein the circulating valve includes hydraulic operation.

20. The apparatus of claim 17 wherein at least one electric motor is a DC motor.

21. The apparatus of claim 17 that includes at least one reversible electric motor.

22. The apparatus of claim 17 wherein the valve fluid is at least partially segregated from the motive fluid.

23. The apparatus of claim 17 wherein the circulating valve is structured to divert motive fluid outside of the BHA.

24. A bottomhole assembly (BHA) in fluid communication with a tubing string, comprising:

a downhole drilling motor in fluid communication with a motive fluid;

a circulating valve responsive to a valve fluid;

valve fluid pressure at least partially independent of motive fluid pressure;

the circulating valve structured in combination with the downhole drilling motor to divert at least a portion of the motive fluid from the downhole motor;

a downhole power pack structured in combination with the circulating valve to pressurize valve fluid, wherein the power pack includes at least one hydraulic pump activated by at least one electric motor; and a first hydraulic pump attached above at least one electric motor and a second hydraulic pump attached below at least one electric motor.

25. The apparatus of claim 24 that includes at least one double acting piston in fluid communication with the first pump and the second pump.

26. The apparatus of claim 24 wherein at least one pump includes a clutch for placing the pump into service and out of service.

* * * * *